US005515405A

United States Patent [19]

Gilmore et al.

[11] Patent Number: 5,515,405

[45] Date of Patent: May 7, 1996

[54] SHIPPING CONTAINER FOR A NUCLEAR FUEL ASSEMBLY

[75] Inventors: Charles B. Gilmore; Nick W. Hille, both of Columbia, S.C.

[73] Assignee: Westinghouse Electric Corporation, Pittsburgh, Pa.

[21] Appl. No.: 407,442

[22] Filed: Mar. 20, 1995

Related U.S. Application Data

[62] Division of Ser. No. 299,697, Sep. 1, 1994.

[51] Int. Cl.[6] ..... G21C 19/06; G21F 5/008

[52] U.S. Cl. ..... 376/272

[58] Field of Search ..... 376/272; 250/506.1, 250/507.1

[56] References Cited

U.S. PATENT DOCUMENTS

| | | | |
|---|---|---|---|
| 4,780,268 | 10/1988 | Papai et al. | 376/272 |
| 4,803,042 | 2/1989 | Gilmore et al. | 376/272 |
| 5,263,063 | 11/1993 | Sappey | 376/272 |
| 5,263,064 | 11/1993 | Sappey | 376/272 |

*Primary Examiner*—Daniel D. Wasil

[57] ABSTRACT

A shipping container is provided for a hexagonal nuclear fuel assembly including a top nozzle having a top end, an outer barrel, an external shoulder, and an inner barrel; a plurality of grids which support fuel rods; and a bottom nozzle having an internal shoulder within a recess, a spherical taper, and a bottom end. The container may include a housing, a support for the fuel assembly, a top nozzle holder secured to the support, plural grid supports secured to the support, plural clamping frames for clamping the grids, plural guide plates for guiding the fuel assembly between adjacent grid supports, and a bottom nozzle holder secured to the support. The top nozzle holder may include a shoulder holder for holding the external shoulder, an end holder for enclosing and holding the top end, and a shoulder clamp for clamping the shoulder holder to the support. The shoulder holder may include a resilient split ring for positioning around the inner barrel and a resilient split support for encasing the resilient split ring. The grid supports may each include two wedges for supporting two sides of the grid, a base plate for fixedly supporting the two wedges thereto, a bearing pad fixedly mounted to the support for slidably supporting the base plate, and shoulder screws for limiting a sliding motion of the base plate on the bearing pad. The guide plates may have a guide side and two surfaces for guiding the two sides of the grids. The guide plates may further have an absorbing side having a coating of gadolinium oxide. The bottom nozzle holder may include a recess holder for holding the internal shoulder. The recess holder may include a wedge mechanism for wedging against the bottom nozzle within the recess and a moving mechanism for moving the wedge mechanism within the recess. The recess holder may also include plural grippers for gripping the internal shoulder and a cam mechanism for moving the grippers.

6 Claims, 15 Drawing Sheets

FIG. 5B
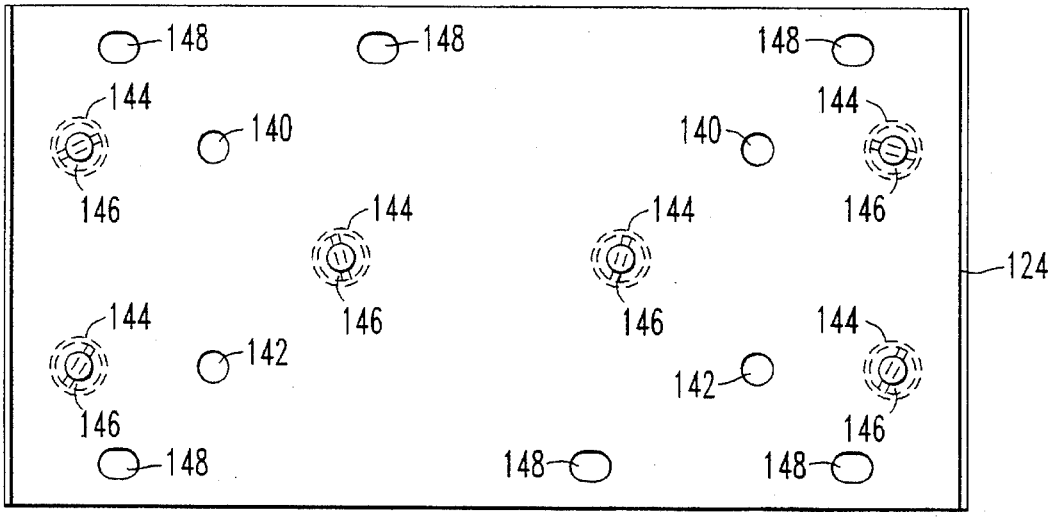
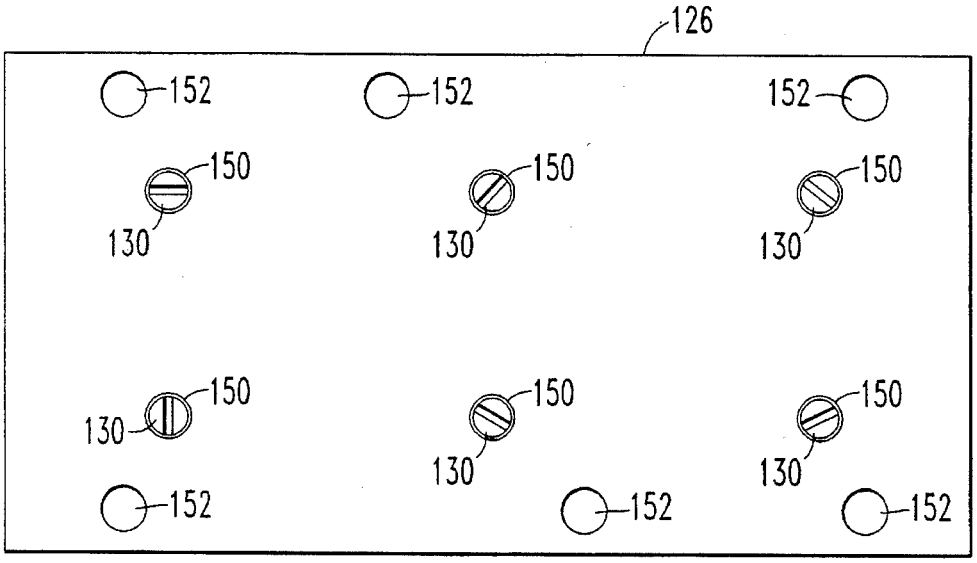
FIG. 5C

SHIPPING CONTAINER FOR A NUCLEAR FUEL ASSEMBLY

CROSS REFERENCE TO RELATED APPLICATION

This is a division of application Ser. No. 08/299,697 filed Sep. 1, 1994.

The inventions taught herein are related to a commonly assigned copending application Ser. No. 08/298,503 entitled "Expandable Top Nozzle and Device for Securing Same to a Nuclear Fuel Assembly" by DeMario et at. (Attorney Docket No. 58,227).

BACKGROUND OF THE INVENTION

1. Field of the Invention

This invention relates to a shipping container for a nuclear fuel assembly, and in particular, to such a container for nuclear fuel assemblies which have a plurality of fuel rods held in a hexagonal array by a plurality of grids spaced longitudinally along the fuel rods. The invention also relates to a hold-down device for securing the bottom nozzle of the nuclear fuel assembly.

2. Background of Information

In the shipping and storage of nuclear reactor fuel elements and assemblies, which contain large quantities and/or enrichments of the fissile material, $U^{235}$, it is necessary to assure that criticality is avoided during normal use, as well as under potential accident conditions. For example, fuel shipping containers are licensed by the Nuclear Regulatory Commission (NRC) to ship specific maximum fuel enrichments (i.e., weights and weight percent $U^{235}$) for each fuel assembly design. In order for a new shipping container design to receive licensing, it must be demonstrated to the satisfaction of the NRC that the new container design will meet the requirements of the NRC Rules and Regulations, including those defined in 10 CFR 71 which is incorporated herein by reference. These requirements define the maximum credible accident (MCA) that the shipping container and its internal support structures must endure in order to maintain the subcriticality of the fuel assemblies therein.

U.S. Pat. No. 4,780,268, which is assigned to the assignee of the present invention and which is incorporated herein by reference, discloses a shipping container for transporting two conventional nuclear fuel assemblies having a square top nozzle, a square array of fuel rods and a square bottom nozzle. The container includes a support frame having a vertically extending section between the two fuel assemblies which sit side by side. Each fuel assembly is clamped to the support frame by clamping frames which each have two pressure pads. This entire assembly is connected to the container by a shock mounting frame and plural shock mountings. Sealed within the vertical section are at least two neutron absorber elements. A layer of rubber-cork cushioning material separates the support frame and the vertical section from the fuel assemblies.

The top nozzle of each of the conventional fuel assemblies is held, along the longitudinal axis thereof, by four longitudinally attached bolts at the four corners of the square top nozzle. The bottom nozzle of some of these conventional fuel assemblies has a chamfered end. These fuel assemblies are held, along the longitudinal axis thereof, by a bottom nozzle spacer which holds the chamfered end of the bottom nozzle.

This and other shipping containers (e.g., RCC-4 for generally square cross-sectional geometry pressurized water reactor (PWR) fuel assemblies) used by the assignee of the present invention are described in certificate of compliance No. 5450, Docket 71-5450, U.S. Nuclear Regulatory Commission, Division of Fuel Cycle and Material Safety, Office of Nuclear Material Safety and Safeguards, Washington, D.C. 20555, which is incorporated herein by reference.

In nuclear reactors of the type originally designed in the former Soviet Union, the reactor core is comprised of a large number of elongated fuel assemblies. Each of these fuel assemblies includes a plurality of fuel rods held in an organized hexagonal array by a plurality of hexagonal grids spaced longitudinally along the fuel rods and secured to stainless steel control rod guide thimble tubes.

Subsequently, the Soviet-style fuel assemblies were redesigned by the assignee of the present invention in order to provide, for example, more reliable operation. The guide thimble tubes of the redesigned fuel assemblies extend above and below the ends of the fuel rods and are attached to top and bottom nozzles, respectively. Such fuel assemblies are arranged in the reactor vessel with the bottom nozzles resting on a lower core plate. An upper core plate rests on the top nozzles. These fuel assemblies may contain $U^{235}$ concentrations of up to about 4.80 to 5.00 weight percent $U^{235}$. Under normal manufacturing conditions, the dimensions of the fuel assemblies may vary. For example, the dimensions of the six sides of the hexagonal array may differ by about ±2.0 mm between individual fuel assemblies.

The top nozzle of the fuel assembly includes a cylindrical outer barrel, a cylindrical inner barrel and a hub. The outer barrel forms a first end of the top nozzle at the top of the fuel assembly. The inner barrel, which has a diameter smaller than the outer barrel, is attached to the hub, which forms a second end of the top nozzle opposite from the first end. The outer barrel has a shoulder facing the second end. The inner barrel telescopes into the outer barrel. The hub interfaces the plurality of fuel rods at the second end.

The relatively heavy (e.g., 70 pounds) top nozzle is susceptible to transportation induced damage to the guide thimble tubes. For example, during normal transportation, vibration in the top nozzle inner barrel may be detrimental to the guide thimble tubes. Because of the unique design of the fuel assembly, which allows movement of the outer barrel along the longitudinal axis of the fuel assembly with respect to the relatively smaller inner barrel, it is not feasible to position adjustable hardware for securing the top nozzle in order to provide the necessary supporting restraint of the fuel assembly during shipment thereof.

The bottom nozzle includes a longitudinally extending recess formed by a hexagonal barrel, a spherical taper, and a cylindrical barrel which has a diameter smaller than the hexagonal barrel. The spherical taper forms a tapered bore within the longitudinally extending recess tapering toward the bottom end. The spherical taper, also, forms an internal shoulder between the hexagonal barrel and the bottom end.

There is a need, therefore, for an improved shipping container for a nuclear fuel assembly having a double-barrelled top nozzle. There is also a need for an improved shipping container for a nuclear fuel assembly having a double-barrelled bottom nozzle.

More particularly, there is a need for such a container for a nuclear fuel assembly having a hexagonal geometry.

There is an even more particular need for such a container which accommodates for manufacturing tolerances in the hexagonal geometry.

There is another more particular need for such a container for a nuclear fuel assembly including a top nozzle having an outer barrel and an inner barrel of smaller diameter which telescopes into the outer barrel.

There is yet another more particular need for such a container for a nuclear fuel assembly including a bottom nozzle having a longitudinally extending recess formed by a hexagonal barrel, a spherical taper, and a cylindrical barrel having a diameter smaller than the hexagonal barrel.

There is still another more particular need for such a shipping container for transporting high enrichment fuel assemblies.

SUMMARY OF THE INVENTION

These and other needs are satisfied by the invention which is directed to a shipping container for a nuclear fuel assembly. The fuel assembly includes an array of a plurality of fuel rods; and a top nozzle having a top end, an outer barrel, an inner barrel, and a shoulder between the barrels. The shipping container may include a support mechanism for supporting the top nozzle and the plurality of fuel rods, a housing for the support mechanism and the fuel assembly, and a top nozzle holder secured to the support mechanism for holding the top nozzle. The top nozzle holder may include a shoulder holder for holding the shoulder. The top nozzle holder may also include an end holder for enclosing and holding the top end. The end holder may further include a spacer member, a resilient spacer and a support member. The spacer member may be secured to the support mechanism. The resilient spacer may be attached to the support member which forms a surface supported by the spacer member for holding the top end of the top nozzle therein. The resilient spacer may separate the support member from the top end of the top nozzle.

The top nozzle holder may further include a shoulder clamp for clamping the shoulder holder to the support mechanism. The shoulder holder may include a resilient split ring having a rust gap for positioning around the inner barrel, and a resilient split support for encasing the resilient split ring. The resilient split support may have a bore running therethrough, a second gap, and a counter-bore which encases the resilient split ring therein adjacent the shoulder. The shoulder clamp may clamp the resilient split support thereby closing the first gap of the resilient split ting, closing the second gap of the resilient split support, and securing the inner barrel to the support mechanism.

The nuclear fuel assembly may also include a bottom nozzle and a plurality of grids supporting the array. The shipping container may further include a support mechanism for supporting the top nozzle, the plurality of grids, and the bottom nozzle; a housing for housing the support mechanism and the nuclear fuel assembly; a top nozzle holder secured to the support mechanism for holding the top nozzle; a plurality of grid supports for supporting the array; a plurality of clamping mechanisms for clamping the array; a plurality of guide plates for guiding the nuclear fuel assembly between adjacent ones of the plurality of grid supports; and a bottom nozzle holder secured to the support mechanism for holding the bottom nozzle.

The support mechanism may have a first surface for abutting the array and a second surface which is perpendicular to the first surface. Each of the plurality of clamping mechanisms may clamp a corresponding one of the plurality of grids to a corresponding one of the plurality of grid supports. Each of the plurality of grid supports may support a corresponding one of the plurality of grids on the second surface.

The nuclear fuel assembly array may be a hexagonal array having six sides. The first surface of the support mechanism may abut a first side of the array. Each of the guide plates may have two surfaces for guiding a second side and a third side of the hexagonal array. Each of the grid supports may include a first support for supporting the second side of the array, a second support for supporting the third side of the array, a base plate for fixedly supporting the first and second supports thereto, a bearing pad for slidably supporting the base plate, and a limiter for limiting a sliding motion of the base plate on the bearing pad which is fixedly mounted to the second surface of the support mechanism. Alternatively, each of the guide plates may have a guide side for guiding the nuclear fuel assembly, and an absorbing side having a coating of gadolinium oxide.

The bottom nozzle of the nuclear fuel assembly may include a longitudinally extending recess. The bottom nozzle holder may be secured to the support mechanism for holding the bottom nozzle and may include a recess holder for holding the bottom nozzle within the longitudinally extending recess. The recess holder may include a wedge mechanism for wedging against the bottom nozzle within the longitudinally extending recess and a moving mechanism for moving the wedge mechanism within the longitudinally extending recess.

The bottom nozzle may further include a bottom end and a tapered bore or shoulder within the longitudinally extending recess tapering toward the bottom end. The recess holder may include a gripper mechanism for gripping the tapered bore or shoulder within the bottom nozzle and a moving or engaging mechanism for moving the gripper mechanism against the tapered bore or shoulder.

The gripper mechanism may include a plurality of grippers for gripping the shoulder within the bottom nozzle. Each of the grippers may have a gripping end and a pivot end. The engaging mechanism may include a base for pivotally mounting the pivot end of each of the grippers and a moving mechanism for moving the gripping end of each of the grippers. The moving mechanism may include an operating mechanism for moving the moving mechanism which engages each of the gripping ends in order to move the gripping ends toward the shoulder within the bottom nozzle. The operating mechanism may also disengage the moving mechanism in order to move the gripping ends away from the shoulder within the bottom nozzle. The base may be inserted adjacent the support mechanism and within the bottom end of the bottom nozzle.

The bottom nozzle may include a hexagonal barrel, a spherical taper, and a cylindrical barrel having a diameter smaller than the hexagonal barrel. The spherical taper may interconnect the hexagonal barrel and the cylindrical barrel which forms the bottom end of the nuclear fuel assembly. The bottom nozzle holder may further include a spacer having a hole for inserting the cylindrical barrel therein and a tapered surface for abutting the spherical taper in order to space the bottom end of the nuclear fuel assembly from the support mechanism.

The moving mechanism may include a earn mechanism having a plurality of cam surfaces for camming a corresponding one of the gripping ends of the plurality of grippers. Adjacent ones of the plurality of grippers may include a spring mechanism for forcing each of the adjacent grippers against a corresponding one of the plurality of cam surfaces.

The nuclear fuel assembly may have a central longitudinal axis. Each of the support mechanism, the base and the moving mechanism may have a hole which is positioned on the central longitudinal axis. The support mechanism may have a surface and the hole of the moving mechanism may be threaded. The operating mechanism may include a screw mechanism for rotating the moving mechanism, a collar, and a spring biased between the moving mechanism and the collar in order to provide a pre-load force for the screw. The screw may have a head and a shaft. The head may abut the surface of the support mechanism. The shaft may have a non-threaded portion and a threaded portion. The non-threaded portion may be adjacent the head and may pass through the holes of the support mechanism and the base. The threaded portion may be adjacent the non-threaded portion and may be threaded through the threads of the hole of the moving mechanism. The collar may be fixedly attached to the threaded portion and separated from the moving mechanism.

The moving mechanism may further include a first blocking mechanism for blocking rotation of the moving mechanism. The first blocking mechanism may include a plurality of blocking surfaces which axe between adjacent ones of the plurality of cam surfaces. Each of the blocking surfaces may abut the corresponding one of the gripping ends of the grippers whenever the moving mechanism is fully disengaged. The moving mechanism may further include a second blocking mechanism for blocking rotation of the moving mechanism. The second blocking mechanism may include a plurality of blocking tabs. Each of the blocking tabs may be attached to a corresponding one of the cam surfaces in order that each one of the blocking tabs abuts the corresponding one of the gripping ends of the grippers whenever the moving mechanism is fully engaged.

Alternatively, a bottom nozzle holder may be provided for use with a shipping container for a nuclear fuel assembly. The nuclear fuel assembly may include a plurality of fuel rods; and a bottom nozzle having a longitudinally extending recess, a bottom end, and a shoulder within the longitudinally extending recess. The bottom nozzle holder may include a gripper mechanism for gripping the shoulder within the bottom nozzle, and an engaging mechanism for engaging the gripper mechanism against the shoulder.

BRIEF DESCRIPTION OF THE DRAWINGS

A full understanding of the invention can be gained from the following description of the preferred embodiments when read in conjunction with the accompanying drawings in which:

FIGS. 5B and 5C are plan views of a base plate and a bearing pad, respectively, for use with the grid support of FIG. 5A;

DESCRIPTION OF THE PREFERRED EMBODIMENTS

Figure 1:
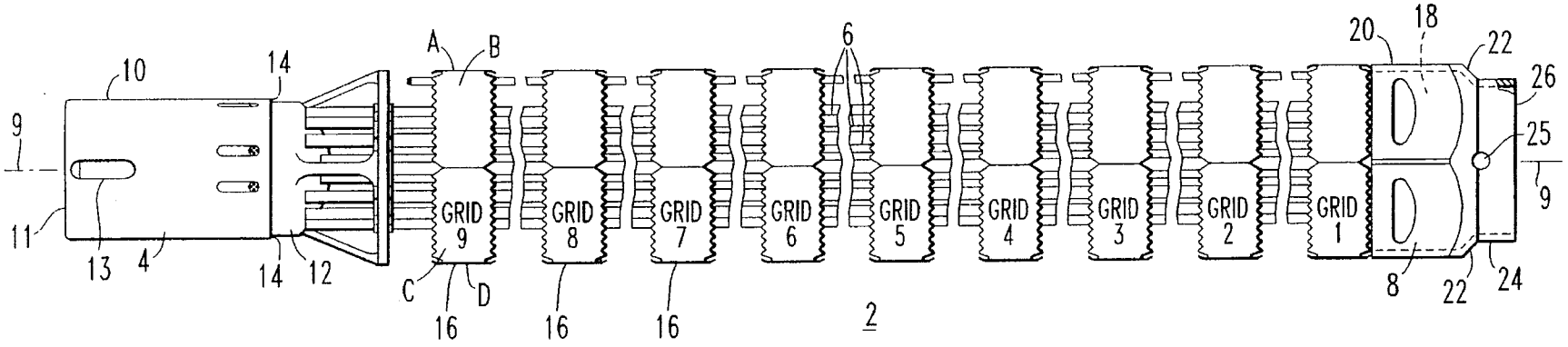
FIG. 1 PRIOR ART
FIG. 1 is a side view of a nuclear fuel assembly having a top nozzle, a hexagonal array of fuel rods and a bottom nozzle.

FIG. 1 illustrates a side view of a nuclear fuel assembly 2. The exemplary VVER 1000 nuclear fuel assembly 2 is manufactured by Westinghouse Electric Corporation which is the assignee of the present invention. The fuel assembly 2 includes a top nozzle 4, a hexagonal array of a plurality of fuel rods 6 and a bottom nozzle 8. The top nozzle 4, the fuel rods 6 and the bottom nozzle 8 are positioned about a central longitudinal axis 9 of the fuel assembly 2. The top nozzle 4 includes a cylindrical outer barrel 10 having a top end 11 and two lifting lugs 13 (only one is shown), a cylindrical inner barrel 12 which telescopes into the outer barrel 10, and a shoulder 14 between the outer barrel 10 and the inner barrel 12. The fuel rods 6 are held in the hexagonal army by a plurality of hexagonal grids 16 spaced longitudinally along the fuel rods 6. The exemplary fuel assembly 2 includes nine hexagonal grids 16 (i.e., GRID 1–GRID 9). Each of the grids 16 has six sides A–D and E–F (shown in FIG. 5A).

The bottom nozzle 8 includes a longitudinally extending recess 18 (shown in shadow) formed by a hexagonal barrel 20, a spherical taper 22, and a cylindrical barrel 24 which has a diameter smaller than the hexagonal barrel 20. Disposed on the cylindrical barrel 24 are two alignment pins 25 (only one is shown). The spherical taper 22 interconnects the hexagonal barrel 20 and the cylindrical barrel 24 which forms a bottom end 26 of the fuel assembly 2. The longitudinally extending recess 18 tapers toward the bottom end 26 and, also, forms an internal shoulder between the hexagonal barrel 20 and the bottom end 26.

Figure 2A:
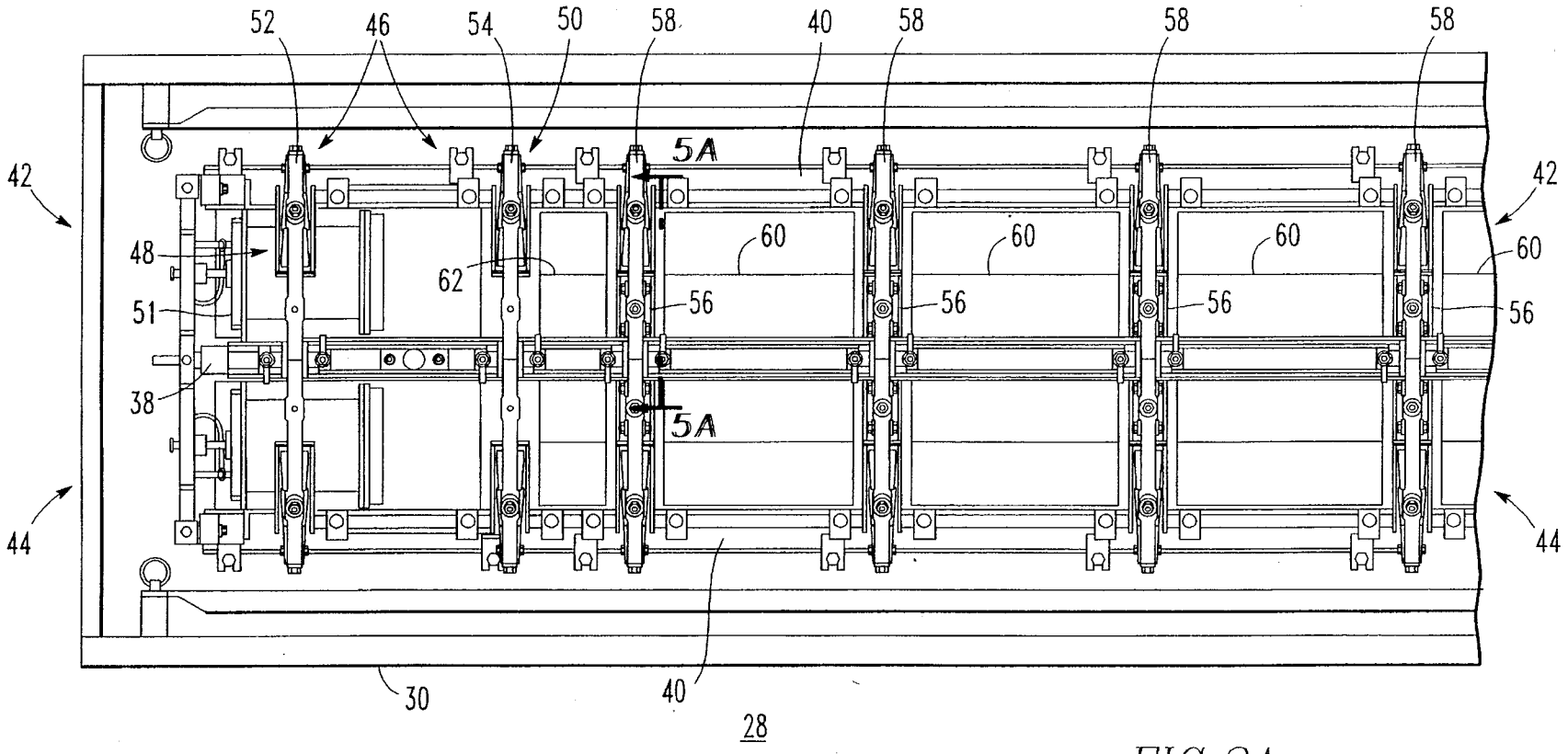
FIGS. 2A–2B when placed side by side depict a plan view of a shipping container in accordance with the present invention.
Figure 2B:
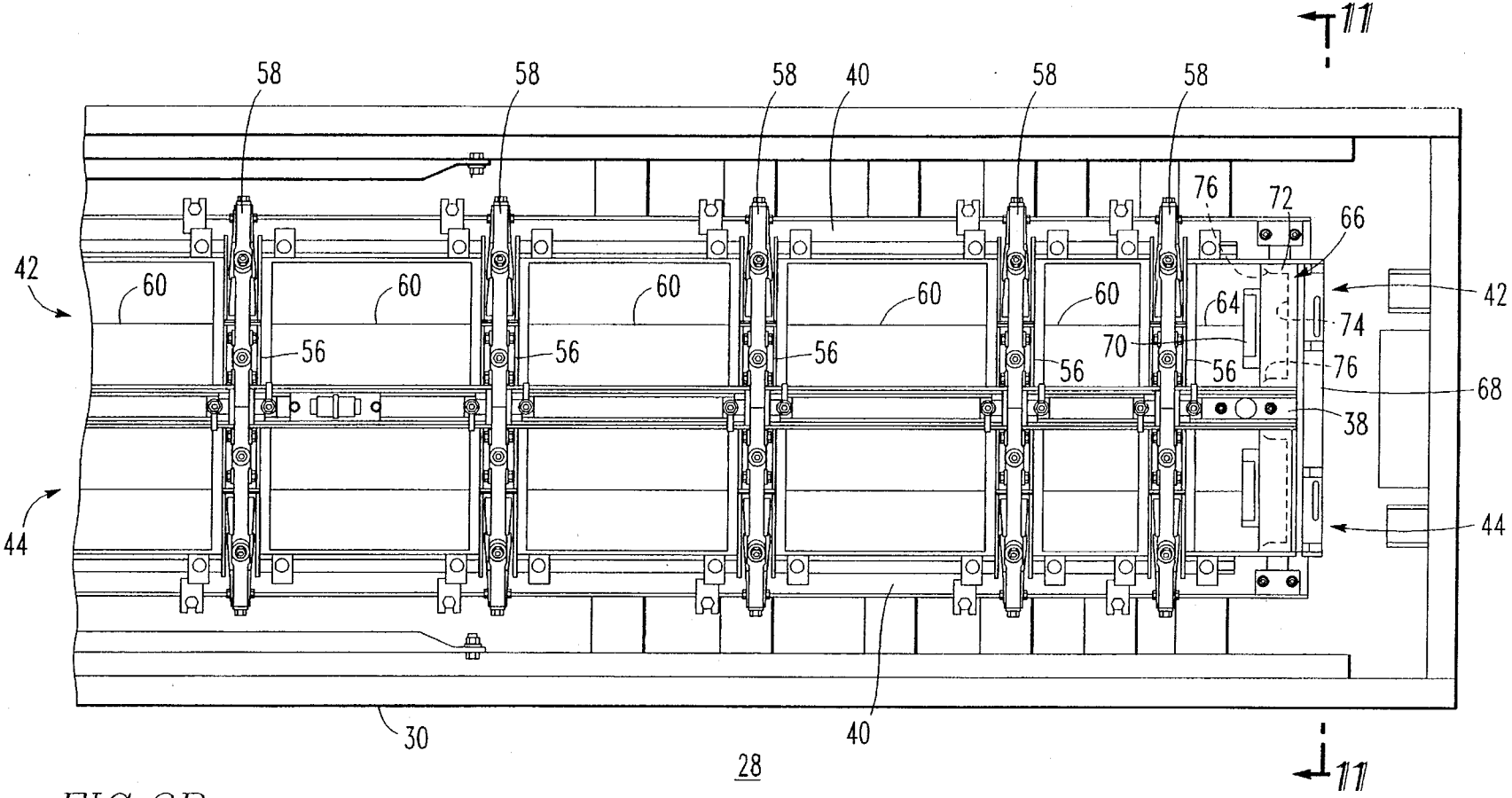
Figure 11:
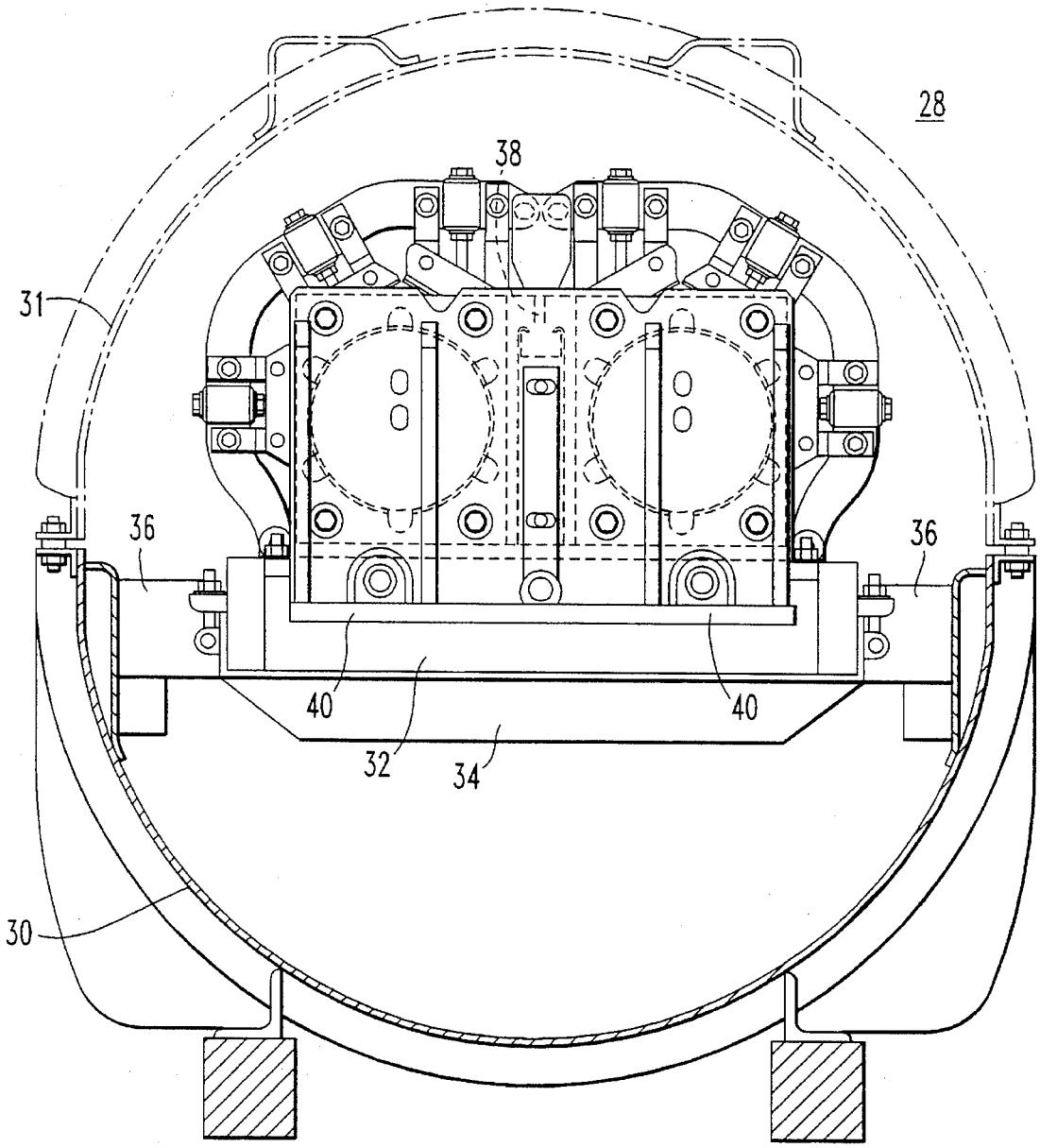
FIG. 11 is a cross sectional view along line 11—11 of FIG. 2B.

Referring to FIGS. 2A–2B, a plan view of a shipping container 28 is illustrated. The exemplary MCC-5 shipping container 28, which houses two of the fuel assemblies 2 (not shown) of FIG. 1, is described in certificate of compliance No. 9239, Docket 71-9239, U.S. Nuclear Regulatory Commission, Division of Fuel Cycle and Material Safety, Office of Nuclear Material Safety and Safeguards, Washington, D.C. 20555, which is incorporated herein by reference. As illustrated by FIG. 11, the container 28 includes an outer housing 30 having a cover 31 (shown in shadow) and an inner support frame 32 which is attached within the housing 30. The support frame 32 is interconnected with the housing 30 by a shock mounting frame 34 and a plurality of shock mountings 36.

The support frame 32 has a vertically extending surface 38 and two horizontal surfaces 40, which are perpendicular to the vertical surface 38, for separating and supporting, respectively, two of the fuel assemblies 2 (not shown) of FIG. 1. As will be explained in greater detail below, the support frame 32 supports the top nozzle 4, the hexagonal grids 16, and the bottom nozzle 8 of the fuel assembly 2 of FIG. 1. Also, each side of the vertical surface 38 of the support frame 32 abuts one of the sides (i.e., side A or side D) of the grids 16 of the two fuel assemblies 2.

Referring to FIGS. 1 and 2A–2B, the following describes a first support apparatus 42 for one fuel assembly 2, it being understood that a second support apparatus 44, which supports another fuel assembly 2, is generally identical to the first support apparatus 42. The exemplary first support apparatus 42 includes a top nozzle holder 46 having an end holder 48 and an intermediate support or shoulder holder 50. The end holder 48 abuts a top support 51 which is fixedly mounted on the horizontal surface 40. The end holder 48 is secured to the horizontal surface 40 by a clamping frame assembly 52. Similarly, the shoulder holder 50 is secured to the horizontal surface 40 by a clamping frame assembly 54. The end holder 48 holds and encloses the top end 11 of the top nozzle 4. The shoulder holder 50 holds the shoulder 14 of the top nozzle 4.

The first support apparatus 42 further includes nine grid supports 56 for supporting the hexagonal array of the nine hexagonal grids 16 (i.e., GRID 1–GRID 9). The grid supports 56 are mounted to the horizontal surface 40. The first support apparatus 42 also includes nine clamping frame assemblies 58 for clamping the hexagonal army at the nine hexagonal grids 16. Each of the nine clamping frame assemblies 58 clamps a corresponding one of the nine grids 16 to a corresponding one of the nine grid supports 56.

Located between adjacent ones of the nine grid supports 56 and the corresponding nine clamping frame assemblies 58 are eight guide plates 60 for guiding the insertion of the fuel assembly 2 into the container 28 and between adjacent ones of the grid supports 56. Two additional guide plates 62, 64 are located between the shoulder holder 50 and one grid support 56 (see FIG. 2A) at one end of the container 28, and between another grid support 56 and a bottom nozzle holder 66 (see FIG. 2B), respectively, at the other end of the container 28. The bottom nozzle holder 66, which holds the bottom nozzle 8 of the fuel assembly 2, is secured to an end support 68 which is fixedly mounted to the horizontal surface 40. The bottom nozzle holder 66 includes a recess holder 70 for holding the bottom nozzle 8 within the longitudinally extending recess 18. The bottom nozzle holder 66 further includes a spacer 72. The spacer 72 has a hole 74 (shown in shadow) for inserting the cylindrical barrel 24 therein and a tapered surface 76 for abutting the spherical taper 22 in order to space the bottom end 26 of the fuel assembly 2 from the end support 68.

Figure 3:
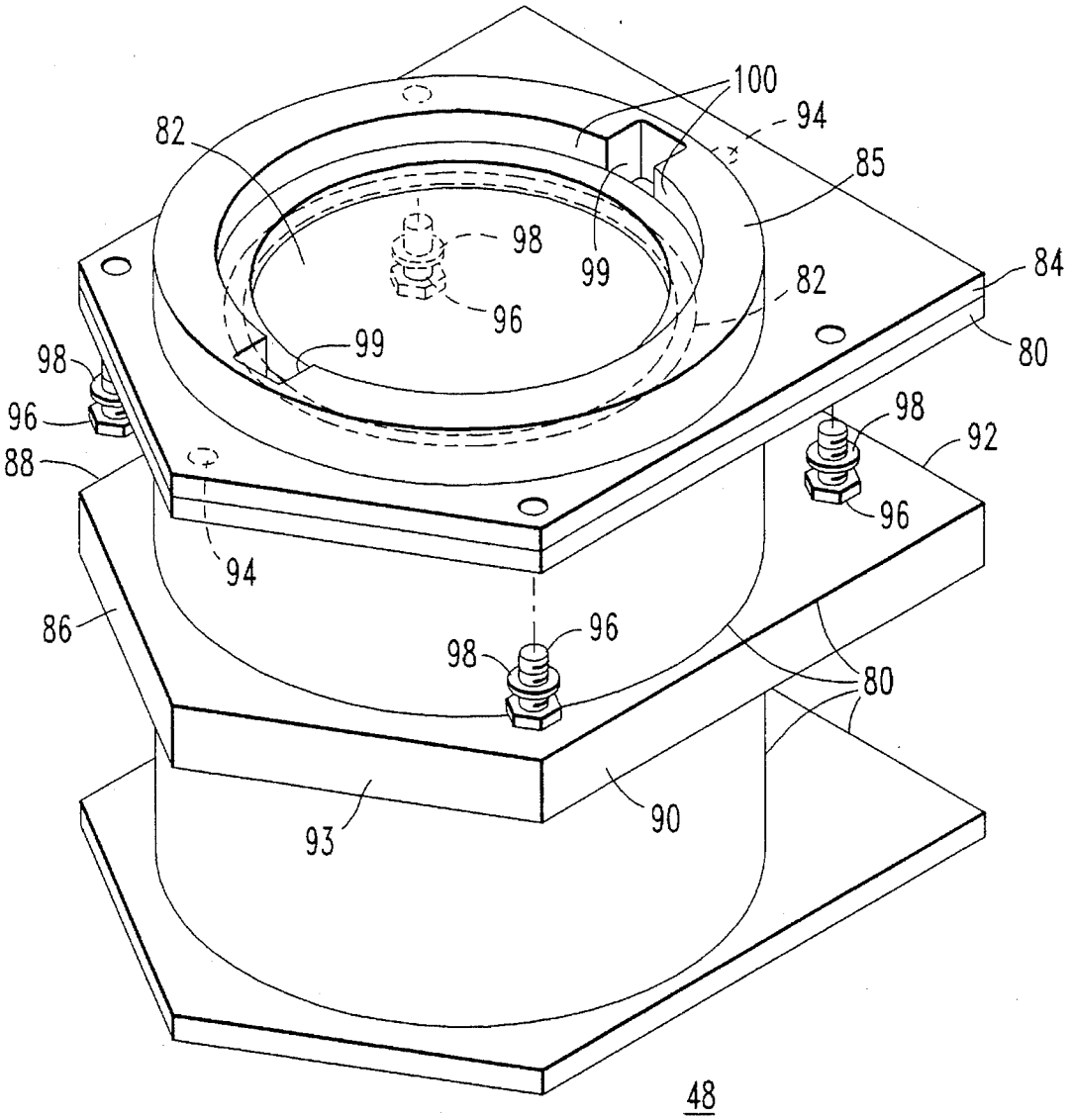
FIG. 3 is an isometric view of a top nozzle support for holding and supporting the top nozzle of a nuclear fuel assembly in accordance with the present invention.

FIG. 3 is an isometric view of the end holder or top nozzle support 48 for holding and supporting the top end 11 of the top nozzle 4 of FIG. 1. The top nozzle support 48 includes a pentagonal spacer member 80, a resilient spacer 82 (partially shown in shadow) and a support member 84 having a support ring 85 welded thereto. As shown in FIG. 2A, the top nozzle support 48 is secured to the horizontal surface 40 of the support frame 32 of FIG. 11 by the clamping frame assembly 52 which clamps two sides 86, 88 of the spacer member 80. Also, two other sides 90, 92 of the spacer member 80 abut the surfaces 38, 40, respectively, of the support frame 32. A fifth side 93 of the spacer member 80 is unsupported.

Continuing to refer to FIG. 3, two internal dowels 94 (shown in shadow) appropriately align the spacer member 80 and the support member 84. These members 80, 84 are attached by a plurality of bolts 96 and washers 98. The exemplary resilient spacer 82 (e.g., a MIL-C-6183A, type II, class 2, grade B cork cushion or equivalent) is adhesively attached to the top of the support member 84 within the support ring 85. The support ring 85 has two relief slots 99 for the lifting lugs 13 of the top nozzle 4 of FIG. 1. The support ring 85 forms a surface 100, which is supported by the support member 84 and the spacer member 80, for holding the top end 11 of the top nozzle 4 therein. The resilient spacer 82 separates the support member 84 from the top end 11. The spacer member 80 provides dimensional compatibility with the top support 51 of FIG. 2A and, furthermore, axially supports the relatively heavy, 70-pound, exemplary top nozzle 4 of FIG. 1. In this manner, any transportation induced damage to the guide thimble tubes 101 (one is shown in FIG. 4B) of the top nozzle 4 is precluded.

Figure 4A:
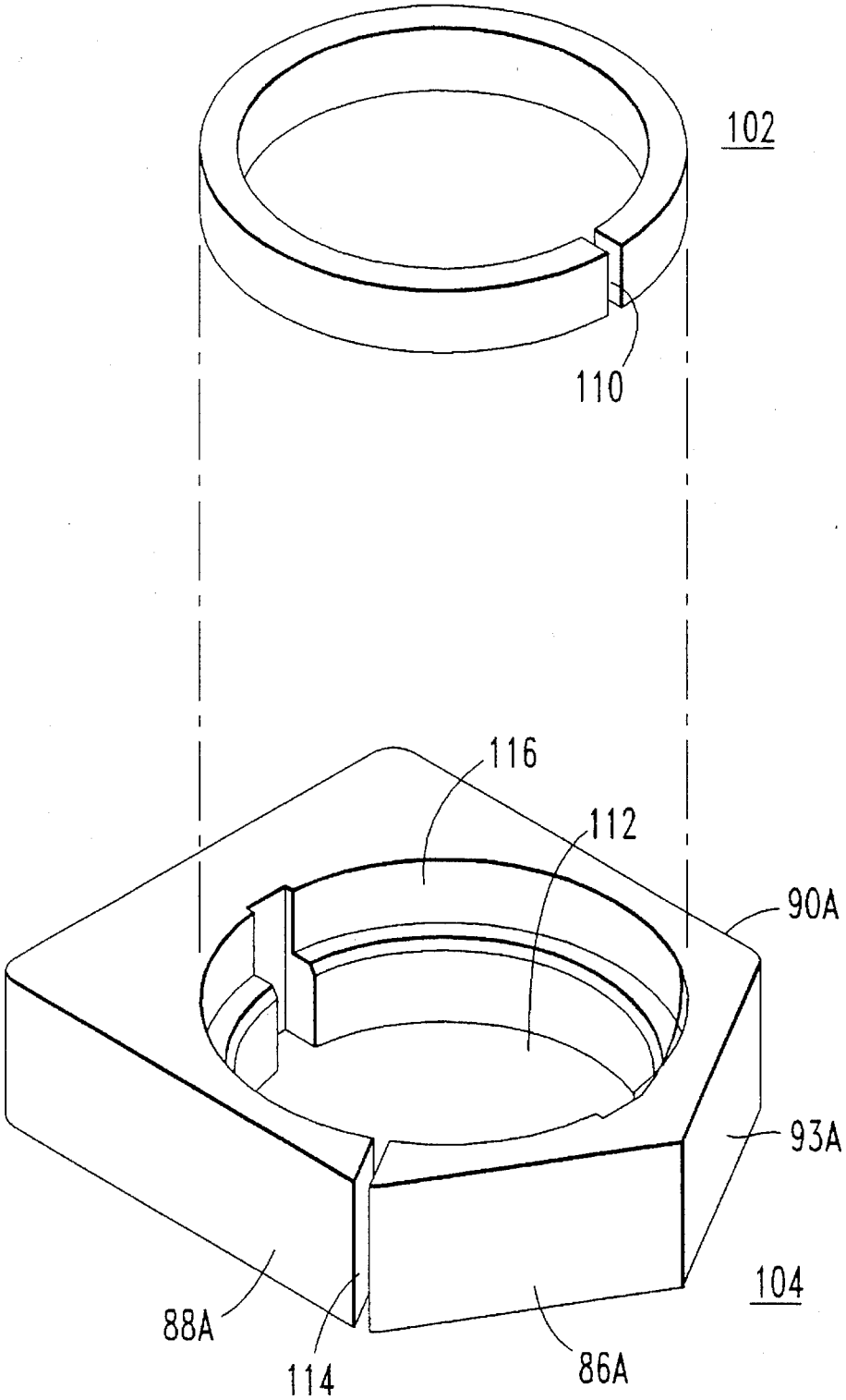
FIG. 4A is an exploded isometric view of a resilient split ring and a resilient split support for supporting a cylindrical inner barrel of the top nozzle in accordance with the present invention.
Figure 4B:
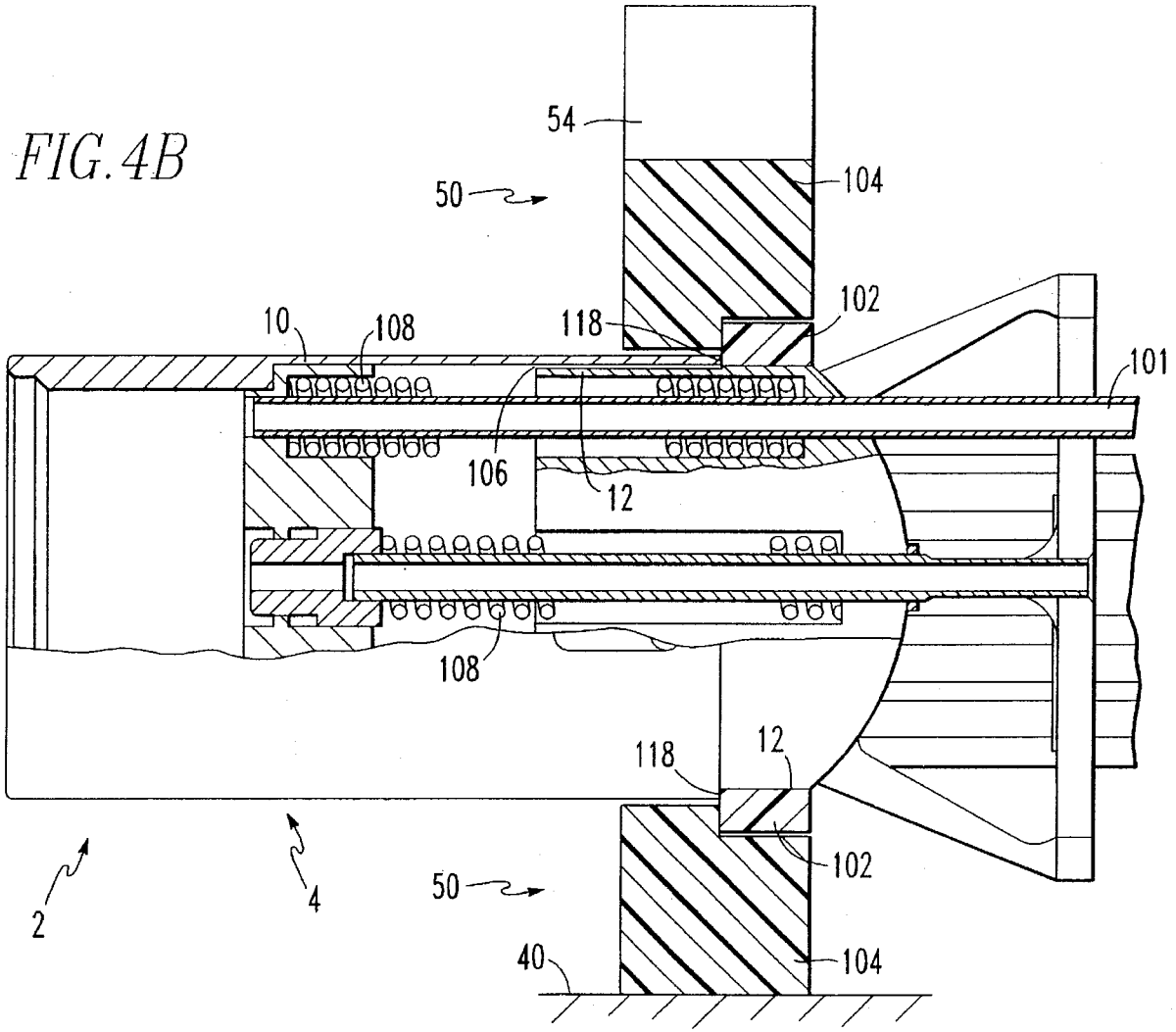
FIG. 4B is a partially cut-away vertical sectional view of a shoulder holder for the top nozzle including the split ring and split support of FIG. 4A in accordance with the invention.

Referring to FIG. 4A, an exploded isometric view of a resilient split ring 102 as used with a resilient split support 104 is illustrated. As shown in FIG. 4B, the shoulder holder 50, which includes the split ring 102 and the split support 104, holds and supports the cylindrical inner barrel 12 of the top nozzle 4 on the horizontal surface 40. The exemplary split ting 102 and the exemplary split support 104 are formed from cast polyurethane.

The small radial clearance 106 between the inner barrel 12 and the outer barrel 10 facilitates pre-load of the top nozzle hold-down springs 108 during assembly and operation of the fuel assembly 2. During normal transportation in the container 28 of FIGS. 2A–2B, the inner barrel 12 may vibrate. This vibration may be detrimental to the guide thimble tubes 101 of the top nozzle 4.

Continuing to refer to FIG. 4A, the split ring 102 has a gap 110 which facilitates positioning of the split ring 102 around the inner barrel 12. The split support 104 has a bore 112 running therethrough, a gap 114, and a counter-bore 116 for encasing the split ring 102 therein adjacent a shoulder 118 of the top nozzle 4. The exemplary gaps 110, 114 each have an opening of about 0.180 inch. The split ring 102 and the split support 104 are installed around the top nozzle 4 when the container 28 of FIGS. 2A–2B is in an upright position. The split ring 102 is first installed over the outer barrel 10 and, then, is positioned around the inner barrel 12. Next, the split support 104 is slid down over the outer barrel 10 in order to encase the split ring 102 in the counter-bore 116 adjacent the shoulder 118.

The gap 114 of the split support 104 of the first support apparatus 42 is positioned toward the upper side of the container 28 of FIG. 2A. The corresponding gap of the split support (not shown) for the second support apparatus 44, which is located between the surfaces 90A, 93A, is positioned toward the lower side of the container 28 of FIG. 2A.

As will be discussed in greater detail with FIG. 6A below, the clamping frame assembly 54 tends to close the gap 114 of the split support 104. In turn, the gap 110 of the split ring 102 also closes. As this gap 110 is closed, the split support 104 becomes fight around both the outer barrel 10 and the split ring 102 and, hence, the inner barrel 12 is secured from vibration during normal transportation. In this manner, the shoulder holder 50 precludes damage to the guide thimble tubes 101.

Figure 5A:
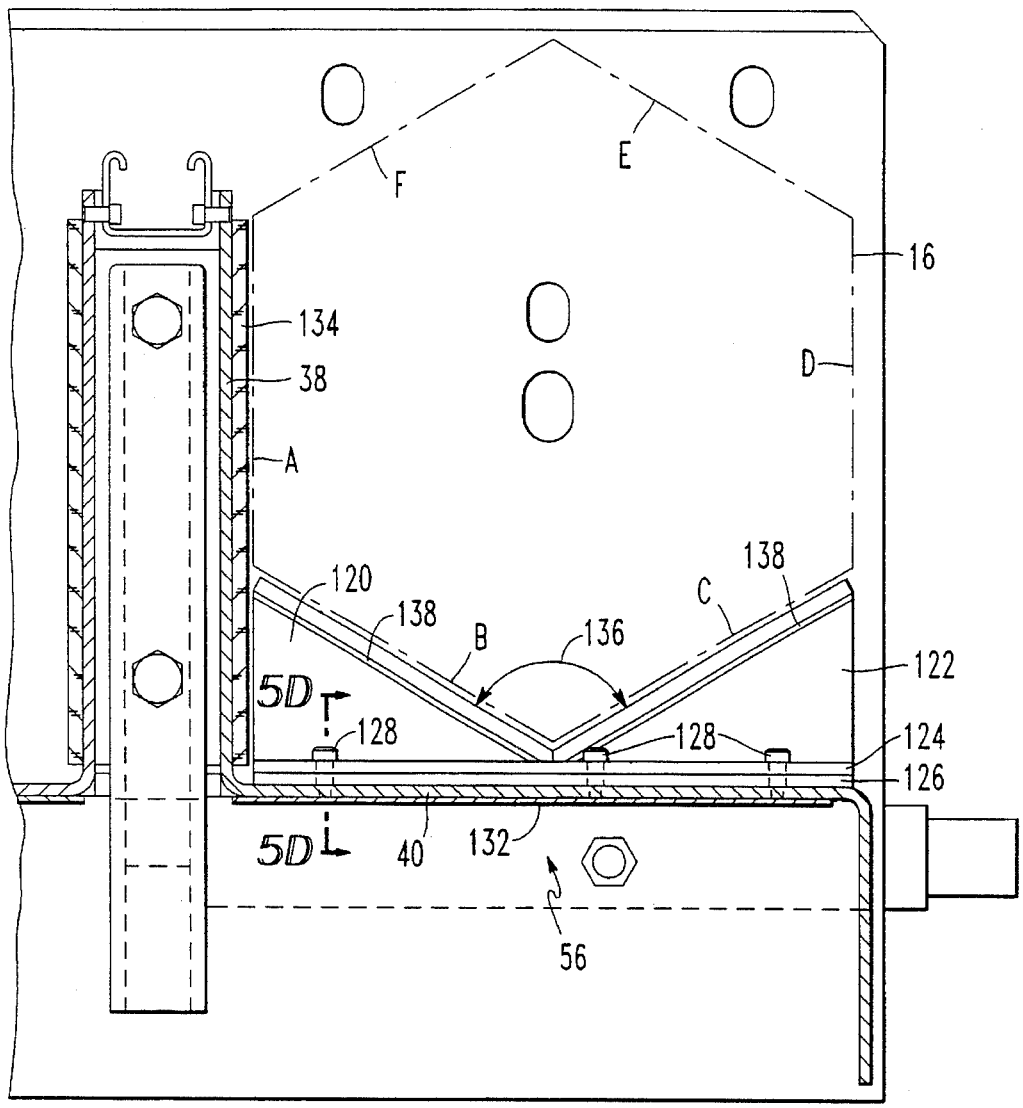
FIG. 5A is a cross sectional view along line 5A—5A of FIG. 2A showing a grid support.

FIG. 5A is a vertical sectional view of the shipping container 28 of FIGS. 2A–2B including one of the grid supports 56. Each of the grid supports 56 includes supports 120 and 122 for supporting the second side, B and the third side C, respectively, of the hexagonal grid 16 (shown in shadow). The grid support 56 also has a base plate 124 for fixedly supporting the supports 120, 122 thereto, a bearing pad 126 for slidably supporting the base plate 124, and a plurality of shoulder screws 128. As will be discussed in greater detail below with FIG. 5D, the shoulder screws 128 facilitate and limit a sliding motion of the base plate 124 on the bearing pad 126. The bearing pad 126 is attached to the horizontal surface 40 by a plurality of flat screws 130 as shown in FIG. 5C. Attached below the horizontal surface 40 is a neutron absorber plate 132. Attached to the side of the vertical surface 38 is a cork cushion 134. This cushion 134 abuts the side A of the hexagonal grid 16.

Each of the exemplary supports 120, 122 has a wedge shape with about a 120° angle 136 therebetween. In this manner, the angle 136 is generally the same as the 120° angle between the sides B,C of the hexagonal grid 16 of FIG. 1. A cork cushion 138, similar to the resilient spacer 82 of FIG. 3, is adhesively attached to each of the supports 120, 122 for supporting the corresponding sides B,C of the hexagonal grid 16.

FIGS. 5B and 5C illustrate plan views of the base plate 124 and the bearing pad 126, respectively. The base plate 124 includes two sets of dowel pins 140, 142 for aligning the supports 120, 122 of FIG. 5A thereon. The base plate 124 also includes six recessed holes 144 (shown in shadow) for use with six flat screws 146 in order to attach the supports 120, 122. The base plate 124 further includes six oblong mounting holes 148 which are described in greater detail below with FIG. 5D. The exemplary bearing pad 126 is made of teflon PTFE material and has six recessed holes 150. The bearing pad 126 also has six holes 152, which have a diameter about the length of the oblong mounting holes 148, for the shoulder screws 128 of FIG. 5A. The six flat screws 130, which are recessed within the six recessed holes 150, fixedly mount the bearing pad 126 to the horizontal surface 40 of FIG. 5A.

Figure 5D:
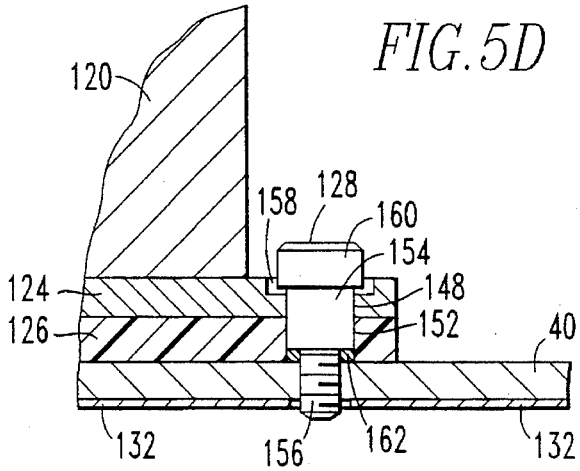
FIG. 5D is a cross sectional view along line 5D—5D of FIG. 5A.

Referring to FIG. 5D, a cross sectional view of the shoulder screw 128 of FIG. 5A is illustrated. Each shoulder screw 128 limits movement of the grid support 56 on the horizontal surface 40. Each shoulder screw 128 has a non-threaded portion 154 which passes through one of the oblong mounting holes 148 of the base plate 124 and, also, passes through one of the other holes 152 of the beating pad 126. Each shoulder screw 128 also has a threaded portion 156 which is threadably attached to the horizontal surface 40. Each of the oblong mounting holes 148 has a counter-bore 158 which separates a head 160 of the corresponding shoulder screw 128 from the base plate 124. A stainless steel shim or washer 162 separates the non-threaded portion 154 from the horizontal surface 40.

Because of normal manufacturing tolerances in the hexagonal grids 16 of FIG. 1, the cork cushions 138 of the two supports 120, 122 cannot be rigid and, hence, must adapt to preclude grid deformation. The counter-bore 158 and the oblong nature of the mounting holes 148 of the base plate 124 provide a clearance between each of the shoulder screws 128 and the base plate 124. This clearance and the teflon bearing pad 126 allow the grid support 56 to slide freely with respect to the horizontal surface 40. The shoulder screws 128, hence, facilitate and limit this sliding motion in the direction which is perpendicular to the longitudinal axis 9 of FIG. 1 and the vertical surface 38 (i.e., a left/right motion with respect to FIG. 5A). The degree of freedom of this motion is, thus, about the longitudinal length of the oblong holes 148 less the diameter of the non-threaded portion 154 of the shoulder screw 128. The width of the oblong holes 148 and the non-threaded portion 154 prevent the sliding motion in the direction which is parallel to the longitudinal axis 9 and the vertical surface 38 (i.e., a left/right motion with respect to FIG. 5D).

In this manner, each of the grid supports 56 accommodates for the gamut of dimensions of the hexagonal grid 16 of the fuel assembly 2 of FIG. 1. Once the fuel assembly 2 is centered on the grid support 56, and pressure is applied to the three sides D–F of the grid 16 by the clamping frame assembly 58 of FIGS. 2A–2B and 6B, both the fuel assembly 2 and the grid support 56 move until the side A of the grid 16 contacts the cork surface 134 adjacent the vertical surface 38.

Figure 6A:
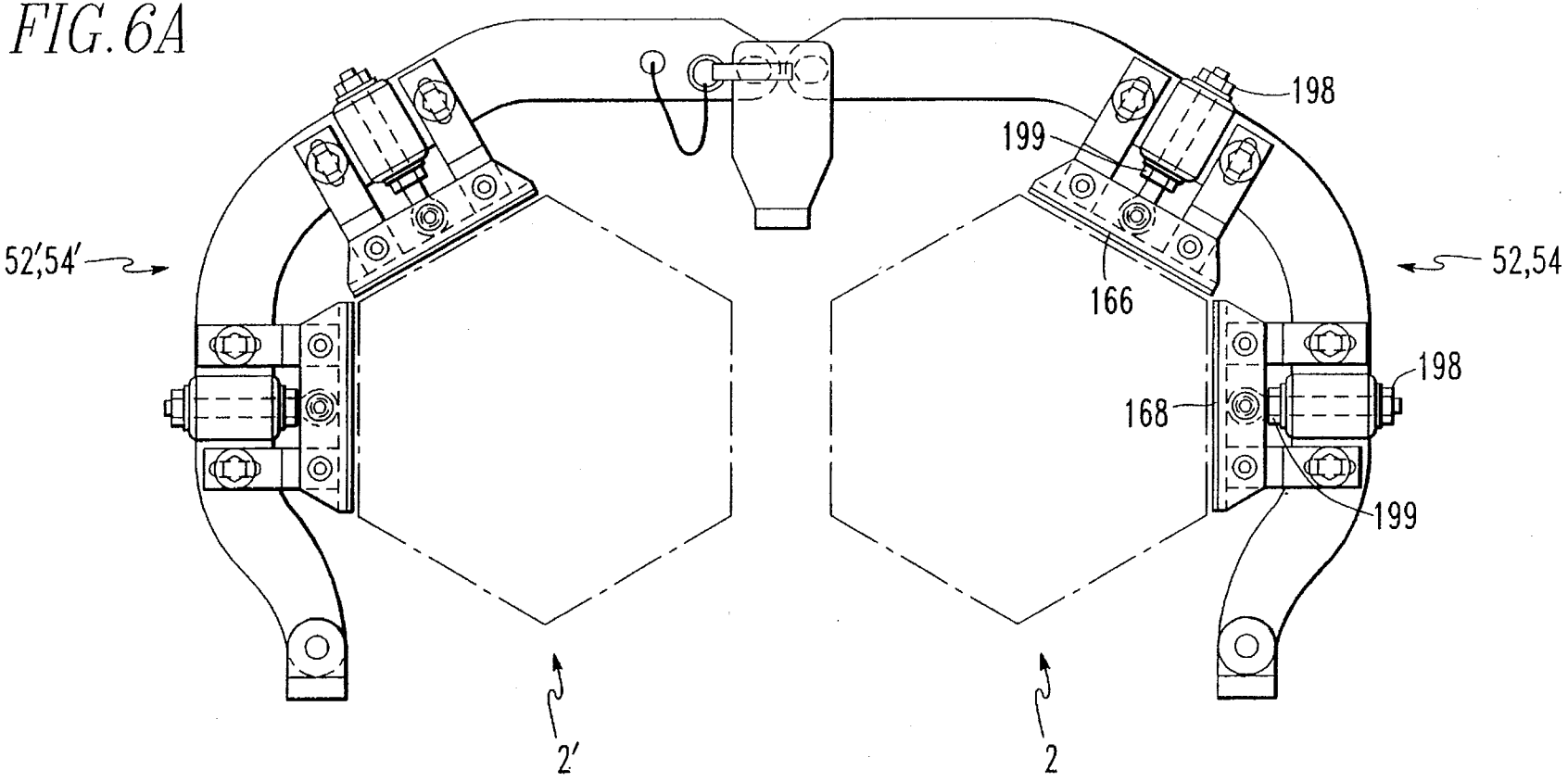
FIG. 6A is a side view of a clamping frame assembly for the top nozzle support of FIG. 3 and for the split support of FIG. 4A.
Figure 6B:
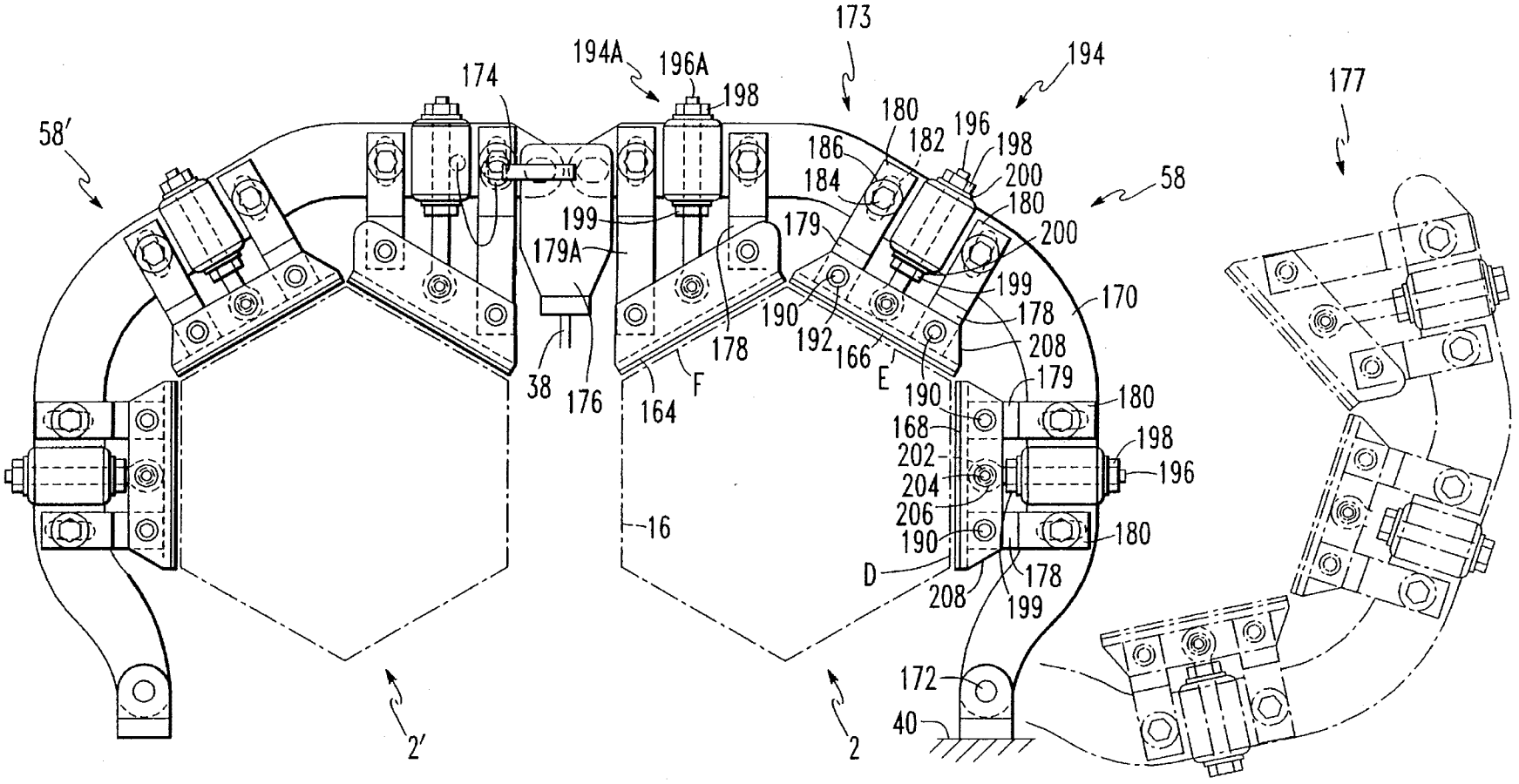
FIG. 6B is a side view of a clamping frame assembly for the grid support of FIG. 5A.

FIG. 6A is a side view of the clamping frame assemblies 52 and 54 for the top nozzle support 48 of FIG. 3 and the shoulder holder 50 of FIG. 4B, respectively. FIG. 6B is a side view of the clamping frame assembly 58 for the grid support 56 of FIG. 5A. With the exception of an additional pressure pad 164 in FIG. 6B, these clamping frame assemblies 52, 54, 58 are identical. FIGS. 6A and 6B also illustrate clamping frame assemblies 52', 54' and 58', respectively, for a second fuel assembly 2'. Such assemblies 52', 54', 58', which are used with the second support apparatus 44 of FIGS. 2A–2B, are minor images of the corresponding clamping frame assemblies 52, 54, 58 for use with the first support apparatus 42 of FIGS. 2A–2B.

Referring to FIG. 6B, the clamping frame assembly 58 includes three pressure pads 164, 166, 168 for use with the sides F,E,D, respectively, of the hexagonal grid 16 (shown in shadow). The pressure pads 164, 166, 168 are adjustably mounted to a frame 170. The frame 170 is pivotally mounted to a pivot mount 172 which is attached to the horizontal surface 40. The frame 170 may be locked in a closed position 173 by a ball lock pin 174 (shown on the clamping frame assembly 58') to a top pivot mount 176 which is fixedly attached to the vertical surface 38. Whenever the ball lock pin 174 is removed, the frame 170 may be unlocked to an open position 177 (shown in shadow).

Each of the pressure pads 166, 168 includes two U-shaped snubbers 178, 179 having two arms 180 (only one of which is shown). Each pair of the arms 180 is adjustably attached to a slot 182 (shown in shadow) in the frame 170 by a hex head bolt 184, a flat washer 186 and an elastic stop nut (not shown). Each of the snubbers 178, 179 is pinned to the corresponding one of the pressure pads 166, 168 by a pin 190 and two retaining rings 192 (only one of which is shown).

An adjustment mechanism 194 for the pressure pads 166, 168 includes a swing bolt 196, two hex nuts 198, 199, two washers 200, two spacers 202 (only one is shown in shadow), a pin 204, and two retaining rings 206 (only one is shown). The pin 204 and two retaining rings 206 mount the two spacers 202 to two arms 208 (only one is shown) of each of the pressure pads 166, 168. The spacers 202 are attached to each side of one end of the swing bolt 196. The swing bolt 196 is adjustably attached to the frame 170 by the pair of nuts 198, 199 and washers 200 on each side thereof. An adjustment mechanism 194A and snubbers 178, 179A for the pressure pad 164 includes a longer length swing bolt 196A and the longer length snubber 179A to accommodate the side F of the hexagonal grid 16 (shown in shadow). The hex nuts 198 function as locking nuts. By tightening each of the pressure pad hex nuts 199, the pressure pads 164, 166, 168 of the clamping frame assembly 58 apply pressure to the corresponding sides F–D of the hexagonal grid 16. The three pressure pads 164, 166, 168 secure the fuel assembly 2 to the grid support 56 of FIG. 5A and, in turn, to the horizontal surface 40. Accordingly, movement of the fuel assembly 2 during a hypothetical accident condition scenario is precluded.

As discussed above, the pressure pad 164 is not used with the clamping frame assemblies 52, 54 of FIG. 6A. For the shoulder holder 50 of FIG. 4B, by tightening the pressure pad hex nuts 199 of the clamping frame assembly 54, the pressure pads 166, 168 apply pressure to close the exemplary 0.180 inch gap 114 of the split support 104 of FIG. 4A. This gap 114 is positioned between the pads 166, 168 which correspond to the two sides 86A, 88A, respectively, of FIG. 4A. The clamping frame assembly 52 applies a similar pressure to the two corresponding sides 86, 88 of the top nozzle support 48 of FIG. 3.

Figure 7A:
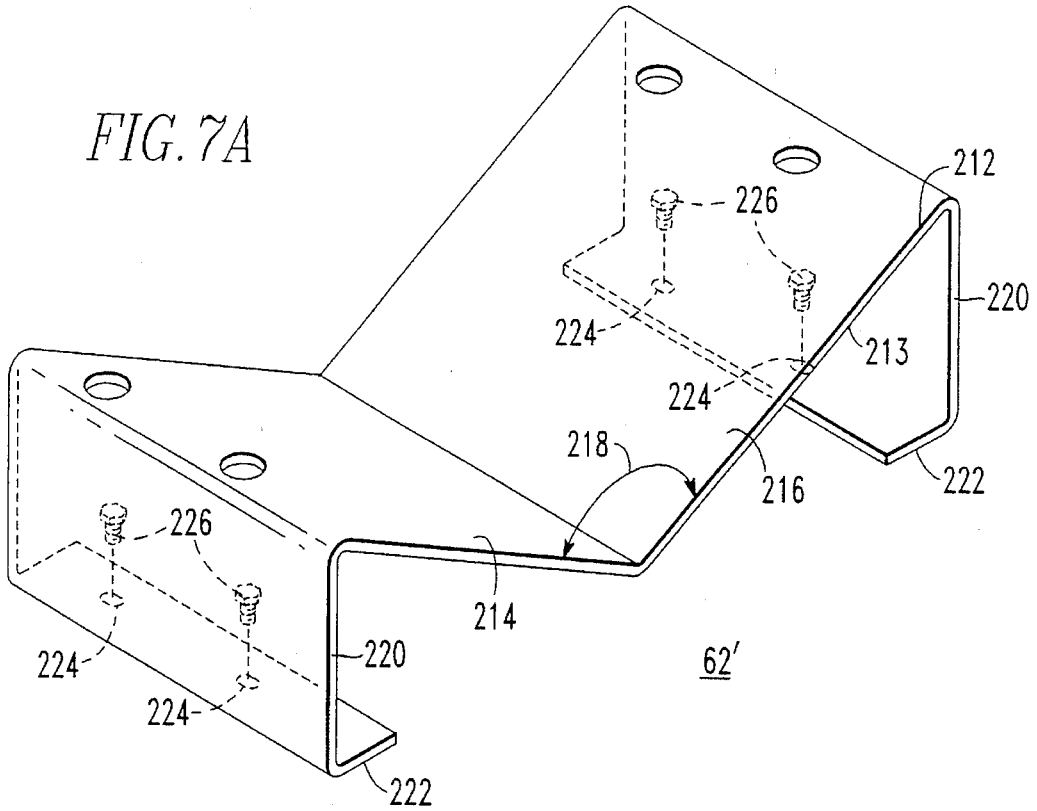
FIG. 7A is an isometric view of a guide plate in accordance with one embodiment of the invention.

FIG. 7A is an isometric view of an alternative guide plate 62', it being understood that the other guide plates 60, 64 have a similar form, except for the width (on the longitudinal axis 9 of the fuel assembly 2 of FIG. 1) as shown in FIGS. 2A–2B, and except as discussed below with the guide plate 62 of FIG. 7B. The guide plate 62' has an upper guide side 212 and a lower side 213. The exemplary guide plate 62' is fabricated from thin steel plate and has two surfaces 214, 216 for guiding the sides B, C, respectively, of the hexagonal grid 16 of FIG. 1. Each of these two surfaces 214, 216 has about a 120° angle 218 therebetween, which corresponds to the angle 136 of FIG. 5A. The guide plate 62' also includes two legs 220 each of which has a foot 222 and two mounting holes 224 (shown in shadow). The guide plate 62' is attached to the horizontal surface 40 of FIGS. 2A–2B by four fasteners 226.

Also referring to FIGS. 1 and 2A–2B, whenever the fuel assembly 2 is loaded in the upright position of the container 28, the fuel assembly 2 is lowered down until the bottom nozzle 8 engages fully in the spacer 72 of the bottom nozzle holder 66. In order to preclude potential damage to the hexagonal grids 16 and the grid supports 56 during loading of the fuel assembly 2, the guide plates 60, 62, 64 are formed to match the 120° angle of the fuel assembly 2 and, hence, preclude the fuel assembly 2 from hanging-up on the grid supports 56 during such loading.

Figure 7B:
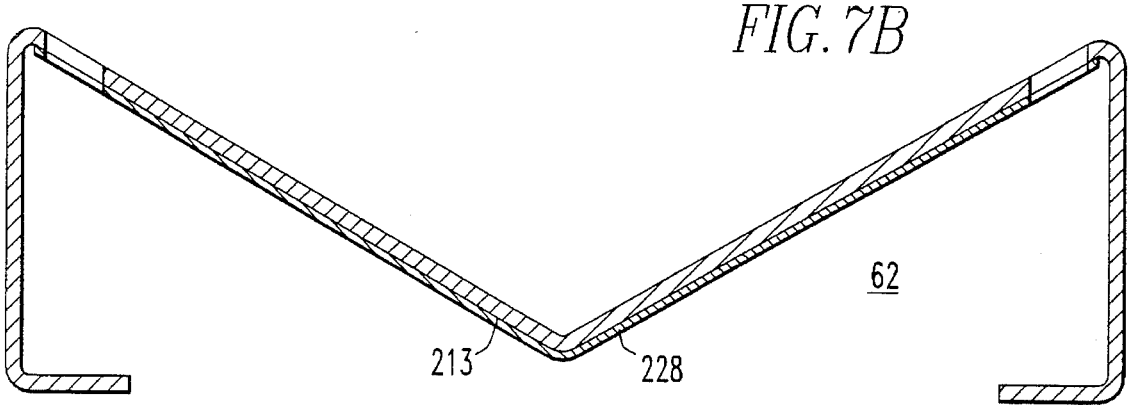
FIG. 7B is a side view of another guide plate in accordance with another embodiment of the invention.

Also referring to FIG. 7B, the guide plate 62 is similar to the guide plate 62' of FIG. 7A, the principal difference being the lower side 213 which has a coating 228 including at least 0.027 gram/cm$^2$ of gadolinium oxide. In this manner, high enrichment (e.g., 4.80 to 5.00 weight percent $U^{235}$) fuel assemblies may be transported by the container 28 of FIGS. 2A–2B. The container 28, in the same manner as the shipping container described in U.S. Pat. No. 4,780,268, also contains horizontal segmented neutron absorber plates 132 (shown in FIGS. 5A and 5D) in addition to vertical absorber plates (not shown). By using the absorber guide plates 60, 62, 64, the container 28 contains a sufficient amount of neutron absorbers and is able to transport such high enrichment fuel assemblies.

Figure 8:
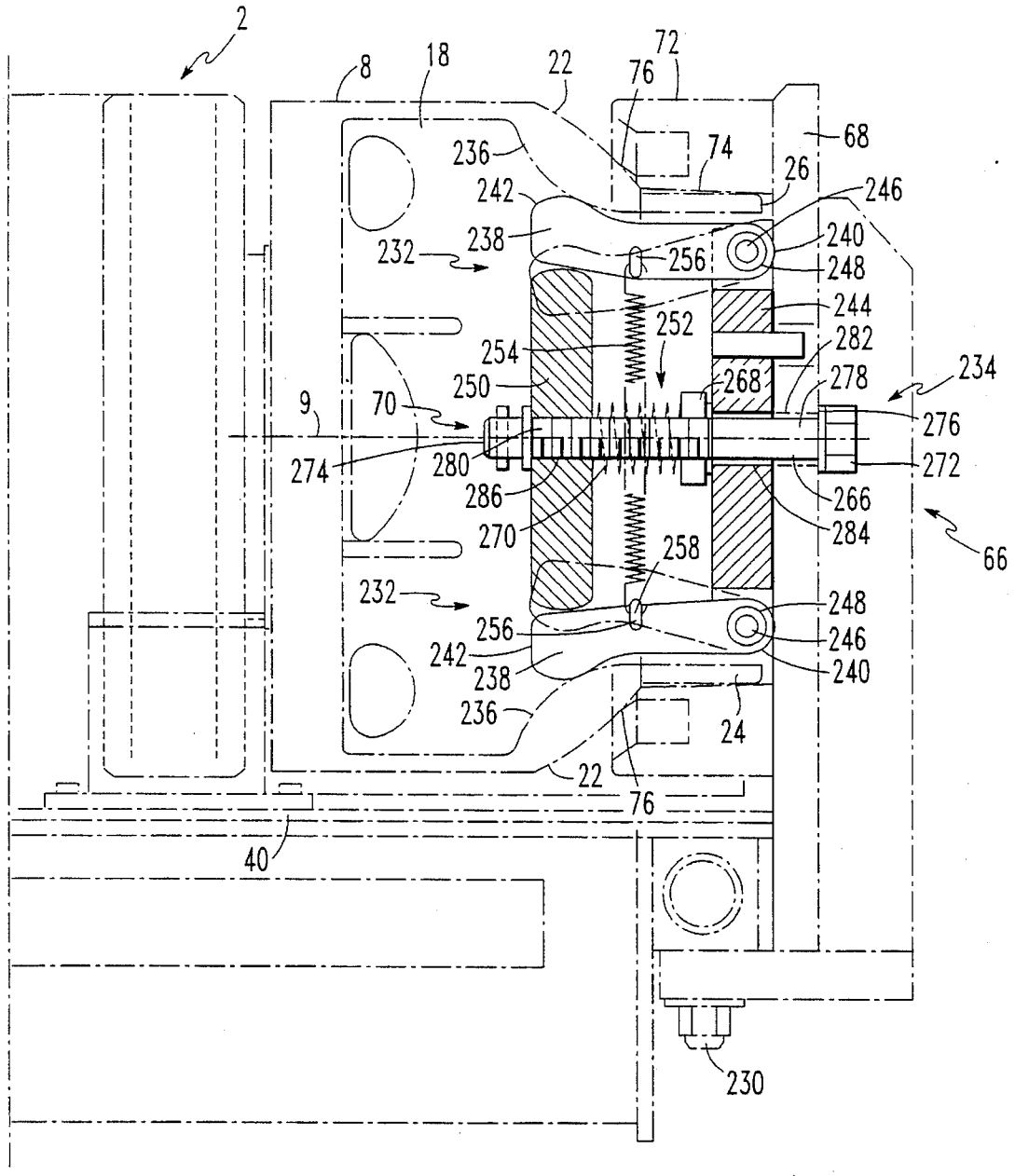
FIG. 8 is a vertical sectional view of a bottom nozzle support and a bottom nozzle spacer in accordance with the invention.

FIG. 8 is a vertical sectional view of the bottom nozzle holder 66 including the recess holder 70 for holding the bottom nozzle 8 (shown in shadow) within the longitudinally extending recess 18 thereof. The exemplary bottom nozzle holder 66 also includes the spacer 72 (shown in shadow) having the hole 74 (shown in shadow) for inserting the cylindrical barrel 24 therein and the tapered surface 76 for abutting the spherical taper 22. The spacer 72 abuts the end support 68 and spaces the bottom end 26 of the fuel assembly 2 therefrom. The end support 68 is fixedly mounted to the horizontal surface 40 by a plurality of bolts 230 (only one of which is shown).

The bottom nozzle holder 66 is a hold-down device which functions as a cam and a wedge to lock the bottom nozzle 8 to the end support 68. The recess holder 70 includes a wedge mechanism 232 for wedging against the bottom nozzle 8 within the longitudinally extending recess 18 and a moving mechanism 234 for moving the wedge mechanism 232 against the bottom nozzle 8 within the recess 18. The wedge mechanism 232 grips a shoulder or tapered bore 236 within the bottom nozzle 8. The moving mechanism 234 moves and engages the wedge mechanism 232 against the tapered bore 236. The wedge mechanism 232 includes three grippers 238 (shown in FIG. 9) each of which have a pivot end 240 and a gripping end 242 for gripping the shoulder 236 within the bottom nozzle 8.

The moving mechanism 234 includes a base 244 on which the pivot end 240 of each of the grippers 238 is pivotally mounted by a pivot pin 246 and two retaining rings 248 (only one of which is shown). The moving mechanism 234 also includes a cam/wedge plate 250 for moving the gripping end 242 of each of the grippers 238 and an operating mechanism 252. The exemplary plate 250 and grippers 238 are made from 17-4 PH precipitate hardened stainless steel. The operating mechanism 252 moves the plate 250 which engages and moves each of the gripping ends 242 radially and angularly outward toward the shoulder 236. The operating mechanism 252 also includes three extension springs 254 (shown in FIG. 9). Each of the three springs 254 is attached between two adjacent grippers 238 by a double-loop wire 256. The double-loop wire 256 is attached near the center 258 of each of the exemplary grippers 238. The three springs 254 provide a net inward force of sufficient magnitude to keep the grippers 238 in contact with the plate 250. In this manner, during loading of the fuel assembly 2, the recess holder 70 is in a "closed" position (see FIG. 9) and, hence, the grippers 238 do not interfere with the bottom nozzle 8.

Figure 9:
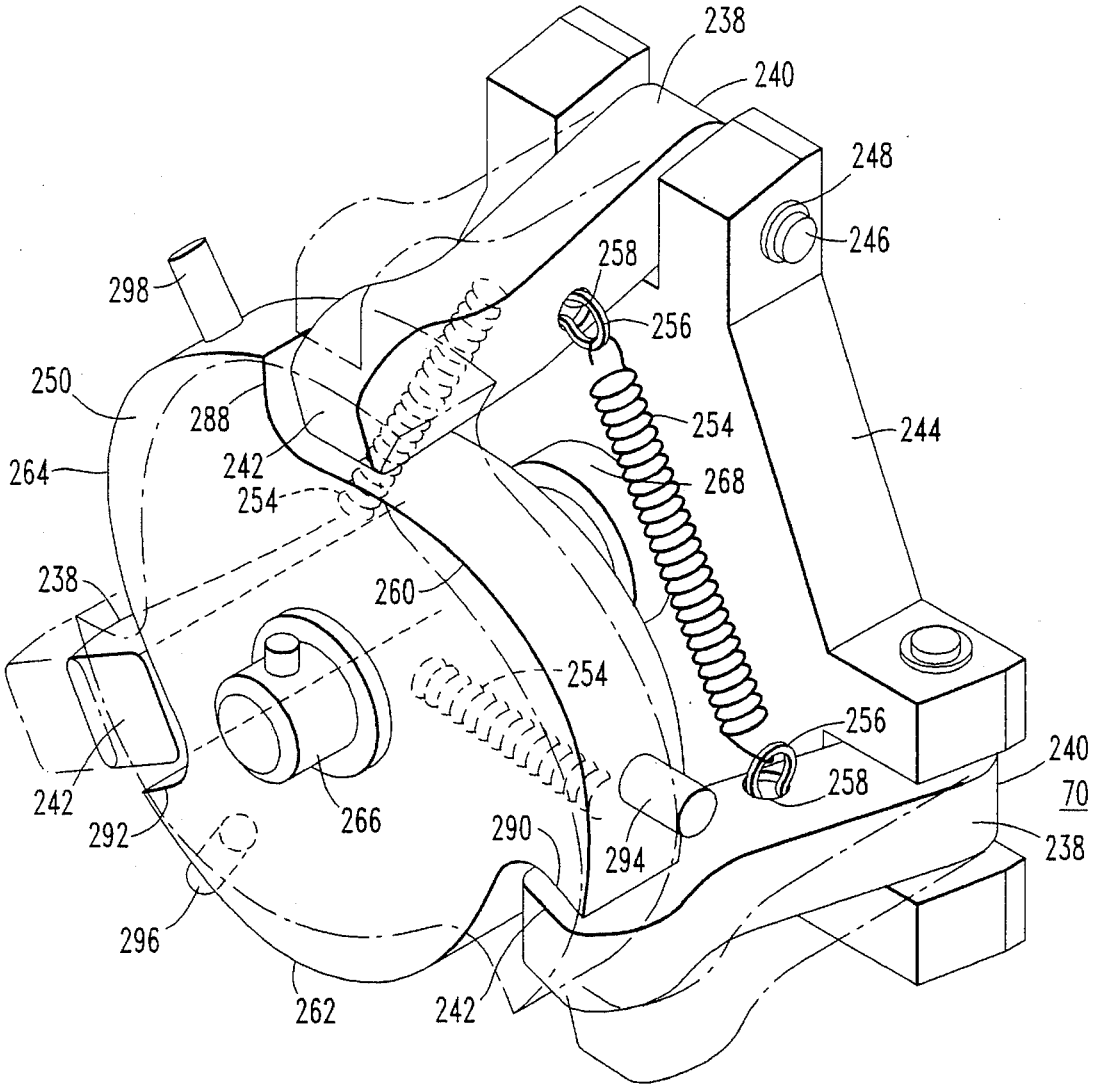
FIG. 9 is an isometric view of a recess holder for the bottom nozzle support of FIG. 8.

Also referring to FIG. 9, the plate 250 includes three cam surfaces 260, 262, 264 for camming a corresponding one of the gripping ends 242 of the three grippers 238. When engaged (as shown in shadow), the cam surfaces 260, 262, 264 move each of the gripping ends 242 radially and angularly outward toward the shoulder 236. When disengaged, as shown, the three springs 254 force the gripping ends 242 radially and angularly inward away from the shoulder 236 and toward the cam surfaces 260, 262, 264.

Continuing to refer to FIG. 8, the operating mechanism 252 further includes a hold-down screw 266, a locking collar 268, and a compression spring 270. The screw 266, which rotates the plate 250, has a head 272 and a shaft 274. The head 272 abuts a surface 276 of the end support 68. The shaft 274 has a non-threaded portion 278 and a threaded portion 280. The non-threaded portion 278, which is adjacent the head 272, passes through a hole 282 of the end support 68 and a hole 284 of the base 244. The threaded portion 280 is adjacent the non-threaded portion 278, opposite from the head 272, and is threaded through a threaded hole 286 of the plate 250. The holes 282, 284, 286 are positioned on the central longitudinal axis 9 of the fuel assembly 2. The locking collar 268, which is fixedly attached to the threaded portion 280, is separated from the plate 250 by the compression spring 270. As shown in FIG. 8, the collar 268 is normally separated from the base 244. Whenever the collar 268 is installed sufficiently tight on the screw 266, the recess holder 70 self-centers within the bottom nozzle 8.

The compression spring 270, which is biased between the plate 250 and the collar 268, provides a pre-load force for the screw 266. The exemplary screw 266, which is fabricated from cold worked stainless steel, provides a sufficient pre-load to the bottom nozzle holder 66 such that the fuel assembly 2 in general, and the bottom nozzle 8 in particular, are securely held to the end support 68 and, hence, are secured to the horizontal surface 40. The remaining parts of the exemplary bottom nozzle holder 66 are fabricated from 300 series stainless steel.

The exemplary screw 266 and, thus, the bottom nozzle holder 66, provide a design load of four times the weight (i.e., 4 G) of the exemplary fuel assembly 2. The screw 266 also provides a quick disconnect mechanism to disengage the bottom nozzle holder 66 for removal of the fuel assembly 2. The base 244 is inserted adjacent the end support 68 and within the bottom end 26 of the fuel assembly 2. As discussed above, the main function of the compression spring 270 is to induce a pre-load between the screw 266 and the plate 250. When the screw 266 is turned to place the recess holder 70 in a full "open" position (shown in shadow in FIG. 9), the pre-load provides a friction couple between the screw 266 and the plate 250. This friction couple is of sufficient magnitude to overcome a friction couple between the grippers 238 and the plate 250. Subsequently, turning the screw 266 rotates the plate 250 which engages the grippers 238. The locking collar 268 provides a contiguous flat biasing surface for the compression spring 270. The spring 270 rotates with the screw 266 and facilitates actuation of the plate 250 to the open position.

The compression spring 270 functions in a similar manner during disengagement of the bottom nozzle holder 66. The screw 266 is turned to release the 4 G pre-load. Whenever the pre-load and the interference between the plate 250 and the grippers 238 are relieved, the plate 250 rotates with the screw 266. In turn, the gripping ends 242 of the three grippers 238 follow the contour of the cam surfaces 260, 262, 264 until the grippers 238 reach the closed position.

Referring to FIGS. 8 and 9, the plate 250 further includes three blocking surfaces 288, 290, 292 between adjacent ones of the three cam surfaces 264–260, 260–262, 262–264, respectively, for blocking rotation of the plate 250. Each of the blocking surfaces 288, 290, 292 abuts the corresponding one of the gripping ends 242 of the grippers 238 whenever the plate 250 is fully disengaged in the closed position.

The plate 250 provides both cam and wedge functions. When the three contoured cam surfaces 260, 262, 264 are moved relative to the corresponding grippers 238, a displacement profile engages (or disengages) the grippers 238. Additional torquing of the screw 266 causes the plate 250 to rotate to the fully open position. When the recess holder 70 is in the fully open position, the plate 250 functions as a wedge. Torquing of the screw 266 pulls or forces the plate 250 toward the base 244. Then, the grippers 238 are forced radially outward relative to the plate 250 in order to engage the inside shoulder 236 of the bottom nozzle 8. This provides a mechanical interference between the plate 250 and the grippers 238 and locks the grippers 238 in place. Accordingly, this engagement of the bottom nozzle holder 66 provides the necessary fuel assembly pre-load and secures the fuel assembly 2 to the end support 68.

The plate 250 further includes three dowel pins or blocking tabs 294, 296, 298 for blocking rotation of the fully engaged plate 250. Each of the blocking tabs 294, 296, 298 is attached to one of the cam surfaces 260, 262, 264, respectively, in order that each one of the blocking tabs 294, 296, 298 abuts the corresponding one of the gripping ends 242 of the three grippers 238 in the fully open position.

On the other hand, to unlock the bottom nozzle holder 66, the screw 266 is turned to remove the pre-load. Continued turning of the screw 266 causes the plate 250 to rotate to the fully closed position. The rotation of the plate 250 stops at the closed position when the grippers 238 contact the blocking surfaces 288, 290, 292. Additional loosening of the screw 266 moves the plate 250 away from the base 244. In turn, the grippers 238 move radially inward and, thus, provide maximum clearance for removing the fuel assembly 2 (e.g., the bottom nozzle 8) from the container 28 of FIGS. 2A–2B (e.g., the bottom nozzle holder 66).

Figure 10:
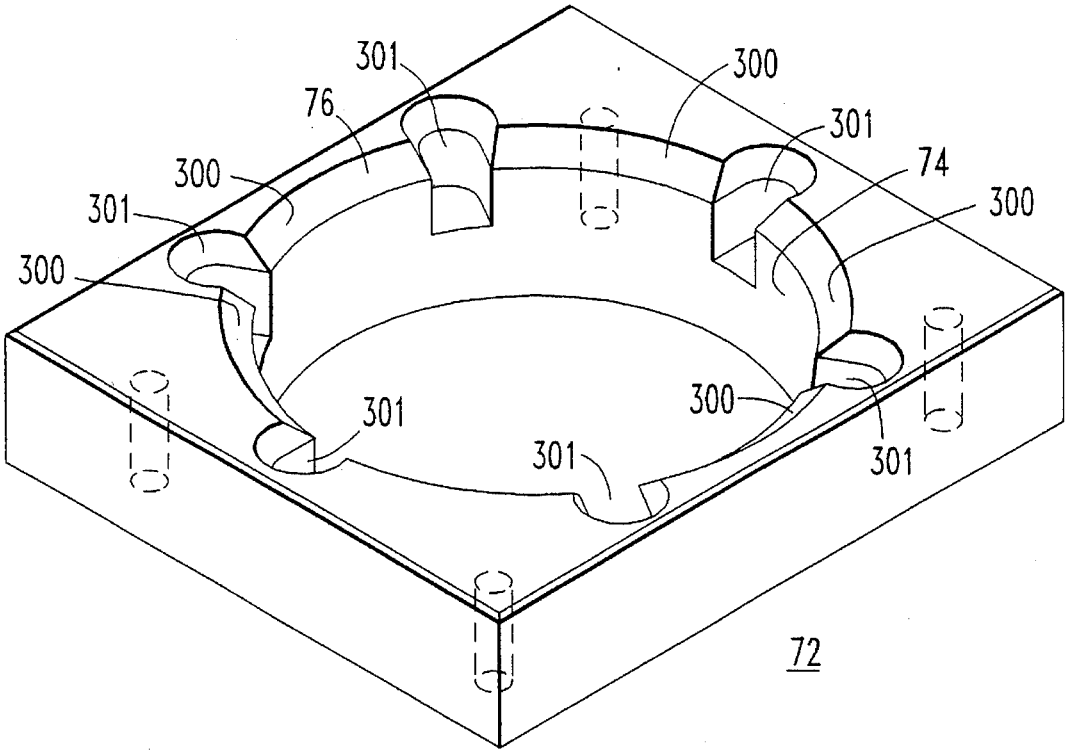
FIG. 10 is an isometric view of the bottom nozzle spacer of FIG. 8.

FIG. 10 is an isometric view of the bottom nozzle spacer 72. Also referring to FIGS. 1 and 2A–2B, the spacer 72 spaces the bottom end 26 of the fuel assembly 2 from the end support 68. The exemplary spacer 72 is made of ASTM 240, type 304 stainless steel in order to preclude contamination of the bottom nozzle 8 by the exemplary end support 68 which is made of carbon steel. The spacer 72 has a machined cavity or hole 74 for inserting the cylindrical barrel 24 therein and a tapered surface 76 for abutting the spherical taper 22. Whenever the container 28 is in the upright position, the fuel assembly 2 is lowered therein. When the fuel assembly 2 is within 3–4 inches of the fully lowered position, the bottom nozzle 8 is manually guided into the hole 74 of the spacer 72. The spacer 72, thus, provides a seating or bearing surface 300 which supports the weight of the fuel assembly 2 during loading in the upright position of the container 28 and, also, holds and supports the bottom nozzle 8 by the spherical taper 22 in both longitudinal and axial directions during transportation of the fuel assembly 2. The spacer 72 also has plural relief slots 301 for accepting the two alignment pins 25 of the bottom nozzle 8.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed:

1. A shipping container for a nuclear fuel assembly including a top nozzle and a plurality of fuel rods; the top nozzle including an outer barrel, an inner barrel and a shoulder between the outer barrel and the inner barrel; said shipping container comprising:

support means for supporting the top nozzle and the plurality of fuel rods;

housing means for housing said support means and said nuclear fuel assembly; and top nozzle holding means secured to said support means for holding the top nozzle of said nuclear fuel assembly, said top nozzle holding means including shoulder holding means for holding the shoulder of the top nozzle.

2. The shipping container as recited in claim 1 wherein the top nozzle has an end and wherein said top nozzle holding means further includes an end holding means for enclosing and holding the end of the top nozzle.

3. The shipping container as recited in claim 2 wherein the end holding means includes a spacer member, a resilient spacer and a support member; the spacer member secured to said support means, the resilient spacer attached to the support member which forms a surface supported by the spacer member for holding the end of the top nozzle therein, the resilient spacer separating the support member from the end of the top nozzle.

4. The shipping container as recited in claim 2 wherein said top nozzle holding means further includes end clamping means for clamping the end holding means to said support means.

5. The shipping container as recited in claim 1 wherein said top nozzle holding means further includes shoulder clamping means for clamping the shoulder holding means to said support means; and wherein the shoulder holding means includes resilient split ring means having a first gap for positioning around the inner barrel, and further includes resilient split support means for encasing the resilient split ring means; the resilient split support means having a bore running therethrough, a second gap, and a counter-bore which encases the resilient split ring means therein adjacent the shoulder; the shoulder clamping means clamping the resilient split support means thereby closing the first gap of the resilient split ring means and closing the second gap of the resilient split support means in order to secure the inner barrel to said support means.

6. The shipping container as recited in claim 5 wherein the resilient split ting means and the resilient split support means are made of polyurethane.

* * * * *